US008695463B2

(12) United States Patent
Su

(10) Patent No.: US 8,695,463 B2
(45) Date of Patent: Apr. 15, 2014

(54) PIVOTING ASSEMBLY FOR HAND TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 13/705,243

(22) Filed: Dec. 5, 2012

(65) Prior Publication Data

US 2013/0291691 A1 Nov. 7, 2013

(30) Foreign Application Priority Data

May 4, 2012 (TW) ..... 101116003 A
Jul. 13, 2012 (TW) ..... 101125324 A

(51) Int. Cl.
*B25B 23/00* (2006.01)

(52) U.S. Cl.
USPC ..... 81/177.7; 81/177.9; 403/144

(58) Field of Classification Search
USPC ..... 81/438–440, 177.1, 177.6, 177.75, 81/177.85; 7/167, 168
See application file for complete search history.

(56) References Cited

U.S. PATENT DOCUMENTS 1,079,531 A * 11/1913 Zahringer ..... 403/144
5,943,925 A 8/1999 Huang
6,443,039 B1 9/2002 Warner
7,174,815 B1 * 2/2007 Hsieh ..... 81/177.9

* cited by examiner

*Primary Examiner* — Monica Carter
*Assistant Examiner* — Melanie Alexander
(74) *Attorney, Agent, or Firm* — Alan Kamrath; Kamrath IP Lawfirm, P.A.

(57) ABSTRACT

A pivoting assembly for a hand tool includes first and second stems pivotally connected with each other, and a positioning device. The first stem includes first and second jaw portions extending from an end thereof. An opening is formed between the first and second jaw portions. An inner periphery surface is formed between the first and second jaw portions. An aperture is extended in the inner periphery surface. The second stem includes at least one arm portion extending from an end thereof. An engaging portion is formed at an end of the arm portion. The engaging portion is engaged with the first and second jaw portions. The positioning device is received in the aperture and abutted against the engaging portion of the second stem.

19 Claims, 15 Drawing Sheets

PIVOTING ASSEMBLY FOR HAND TOOL

BACKGROUND OF THE INVENTION

1. Field of the Invention

The present invention relates to a pivoting assembly and, more particularly, to a pivoting assembly for a hand tool foldable to a compact configuration which is excellent for applying high torque to turn objects.

2. Description of the Related Art

A conventional wrench, for example, an Allen wrench, used to grip and turn or twist objects, usually rotary fasteners, such as the head of a bolt, a nut, a pipe, or the like, commonly typically comprises a one-piece L-shaped metal with one end used as the driving stem and the other end used as a handle.

U.S. Pat. No. 5,943,925, Huang, discloses a tool having a foldable structure. The foldable structure disclosed by Hung includes a coupler pivotally coupled between a driving stem and a handle. Applying the foldable structure to the Allen wrench, the driving stem can be folded in parallel with the handle, that is, with a zero angle relative to the handle. This results in a more compact space for storing the tool. In Huang, with respect to the handle, the driving stem can be rotated from an angle of zero degree to an angle of 180 degrees. While turning a fastener in a limited, narrow space, for example, around the boundary of two perpendicularly adjoining planes, the handle of the Allen wrench adopting the foldable structure disclosed by Huang can only be turned between zero degree to 180 degrees along a surface perpendicular to the driving stem. When a half circle of the turning action is complete, the user must disengage the Allen wrench from the fastener. By repositioning the handle to the initial point of the turning action, the turning action is repeated until the fastener is fastened as required. In other words, while tightening or untightening the fastener in a plane with a limited degree of freedom, the user may need to repeat engaging and disengaging the driving stem to reposition the handle. Moreover, using this conventional foldable structure, there is only one end of the wrench that can be used as the driving tool while the other end is used as a handle only. When a different torque is required, or the fastener with a different depth is to be driven thereby, a different driving stem has to be connected and reassembled.

U.S. Pat. No. 6,443,039, Warner, discloses a wrench having two driving stems pivotally connected with each other. One of the driving stems has a female fork joint protruding from a main stem with a hole at the center thereof. The other driving stem has a male connecting joint protruding from the axial center of the main stem. The male joint and the female joint are engaged with each other via a connector such as a roll pin. Therefore, without using an additional hinge or other mechanical coupler, these two driving stems are pivotally connected with each other. One of these two pivotally connected driving stems flips from an angle of about 90 degrees to an angle of about 270 degrees relative to the other.

Therefore, the tool disclosed by Huang and Warner must include holes respectively formed at the two stems. Thus, a pin is inserted through the holes of the two stems to cause the two stems to be pivotally connected with each other. However, the holes formed at the two stems will decrease the strength of the tool so that the tool can not apply high torque to turn objects.

The present invention is, therefore, intended to obviate or at least alleviate the problems encountered in the prior art.

SUMMARY OF THE INVENTION

The present invention solves this need and other problems in the field of a pivoting assembly for a hand tool including first and second stems pivotally connected with each other, and a positioning device. The first stem includes a first connecting end, a first driving end spaced from the first connecting end, and first and second jaw portions respectively extending from the first connecting end. An opening is formed between distal end faces of the first and second jaw portions. An inner periphery surface is formed between the first connecting end and the first and second jaw portions. An aperture is extended in the inner periphery surface. The second stem includes a second connecting end, a second driving end spaced from the second connecting end, and at least one arm portions extending from the second connecting end. An engaging portion is formed at an end of the arm portion opposite to the second connecting end. The engaging portion includes an outer periphery surface and is engaged with the first and second jaw portions, with the outer periphery surface abutted against the inner periphery surface. The positioning device is received in the aperture and abutted against the engaging portion of the second stem.

The first driving end is spaced from the first connecting end along a first axis. Moreover, the first driving end of the first stem can drive objects and is adapted to be gripped as a handle by a user. The second driving end is spaced from the second connecting end along a second axis.

Furthermore, the first and second jaw portions respectively extend from top and bottom faces of the first connecting end along a direction parallel to the first axis and a direction parallel to a third axis.

The positioning device includes a biasing member and an engaging member. In a preferred form, the biasing member is a spring, and the engaging member is a cylindrical block.

When the second stem is pivoted relative to the first stem to cause the first and second axes to be coaxial, the engaging member is engaged in the abutting recess formed at the outer periphery surface and abuts against a bottom surface of the abutting recess.

When the second stem is pivoted clockwise relative to the first stem to cause the second and third axes to be coaxial, the engaging member is engaged in the abutting recess, and an end face of the engaging member is firmly attached with the bottom surface of the abutting recess. Therefore, the second stem is disposed relative to the first stem with an included angle quickly.

When the second stem is pivoted counterclockwise relative to the first stem to cause the first and second axes to be mutually perpendicular, the bottom face of the first connecting end of the first stem abuts against the terminal face of the second connecting end of the second stem, with the engaging member abutted against the outer periphery surface of the engaging portion.

An advantage of the pivoting assembly for the hand tool according to the present invention is that the pivoting assembly for the hand tool includes first and second stems pivotally connected with each other without a pin to prevent forming holes for inserting the pin at the two stems to keep the strength of the pivoting assembly so that the hand tool can apply high torque to turn objects.

Another advantage of the pivoting assembly for the hand tool according to the present invention is that the engaging portion of the second stem is engaged and received between the first and second jaw portions to cause the outer periphery surface of the engaging portion to be in contact with the inner periphery surface, with the outer diameter of the outer periphery surface of the engaging portion being greater than the width of the opening to cause the second stem to be unable to disengage from the first stem.

Another advantage of the pivoting assembly for the hand tool according to the present invention is that the biasing member is abutted and biased against the engaging member to cause the engaging member to engage within the abutting recess of the second stem resulting in the second stem being unable to disengage from the first stem along a direction perpendicular to the second axis.

A further advantage of the pivoting assembly for the hand tool according to the present invention is that the first and third axes form the included angle, which may be formed about zero degree to 90 degrees, and the aperture is extended along the third axis in the inner periphery surface and receives the positioning device to cause the positioning device to be unable to disengage from the aperture.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
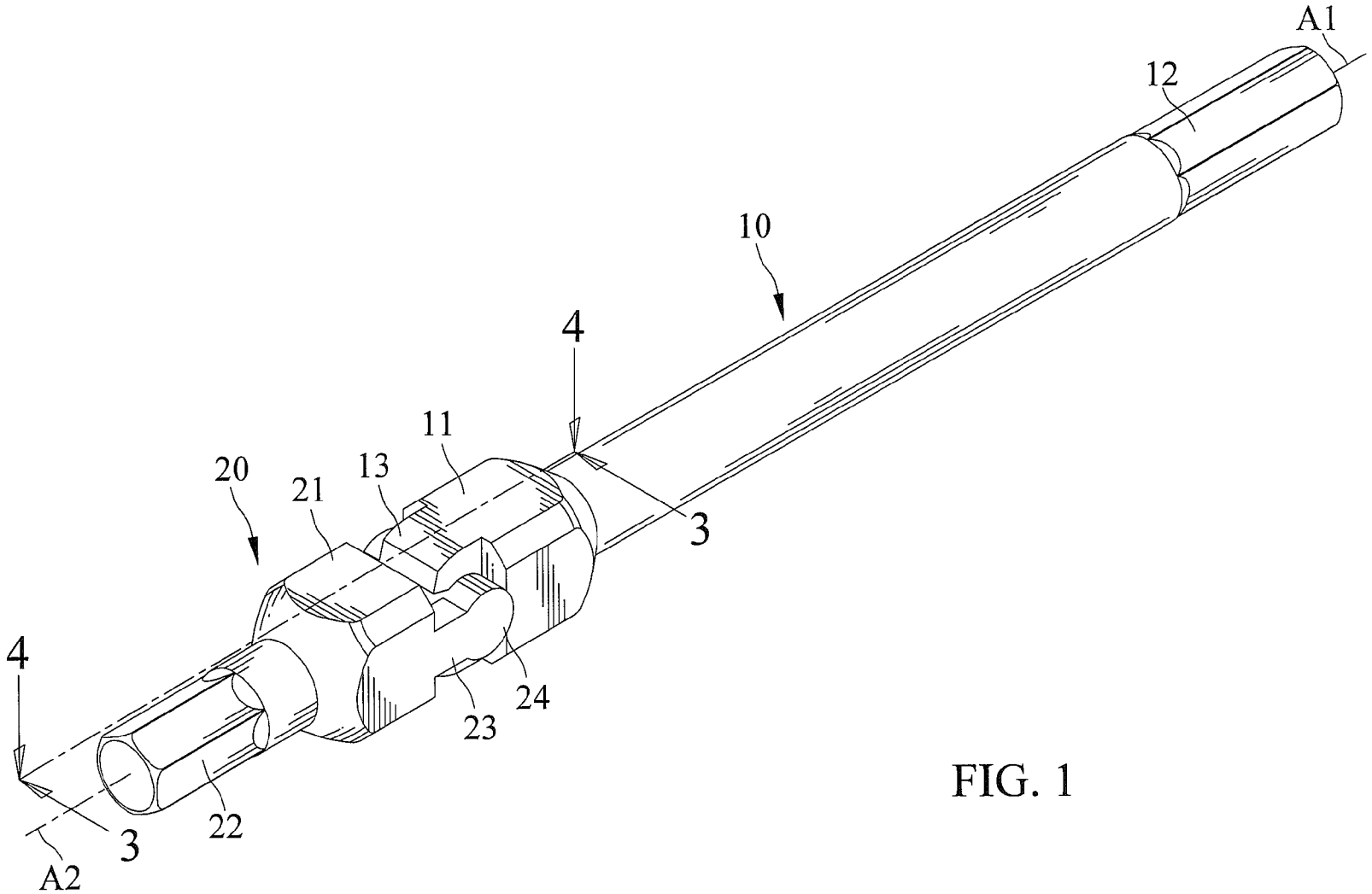
FIG. 1 shows a perspective view of a pivoting assembly for a hand tool of a first embodiment according to the present invention, and illustrates first and second axes being coaxial.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE PREFERRED EMBODIMENTS

Figure 2:
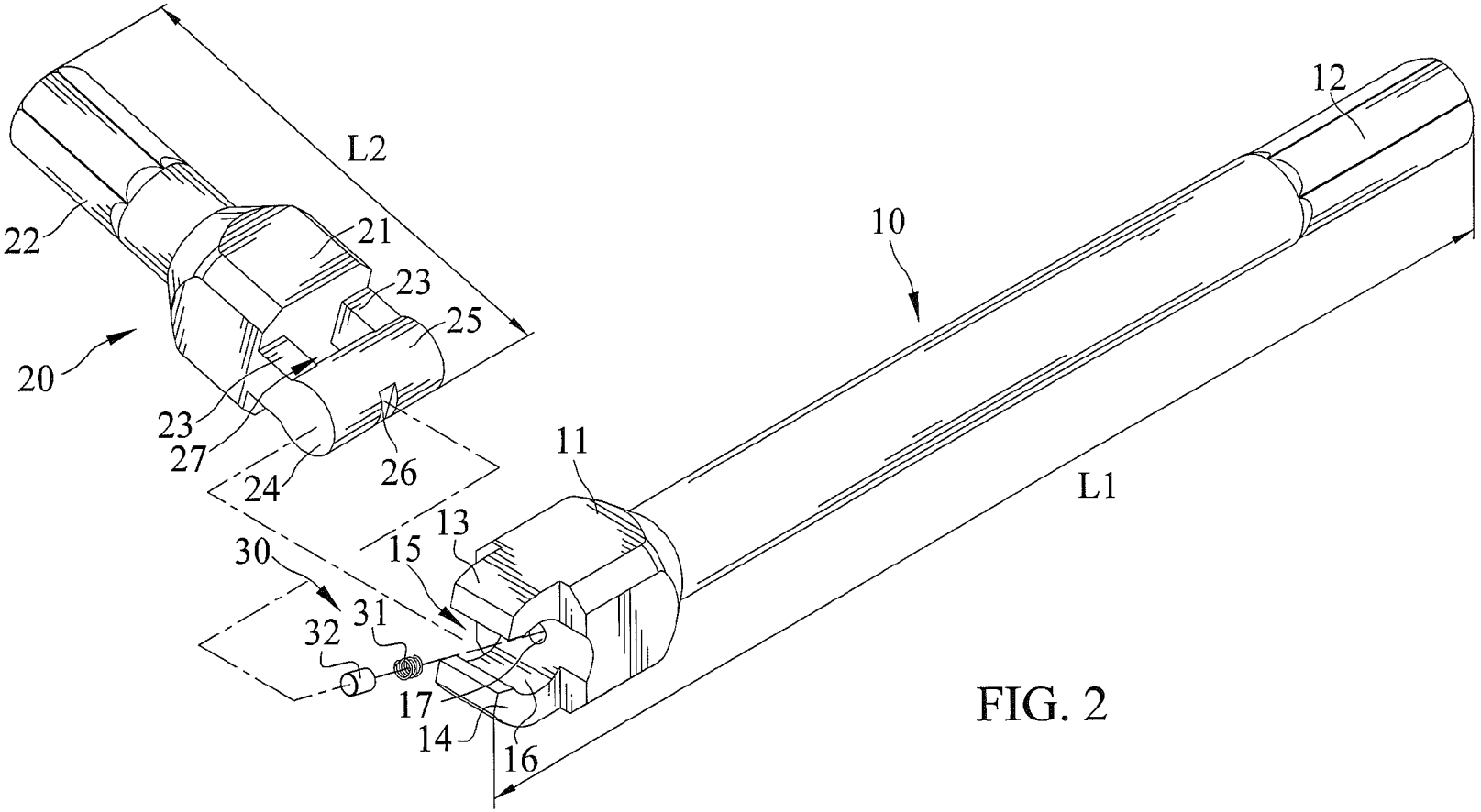
FIG. 2 shows an exploded, perspective view of the pivoting assembly for the hand tool of FIG. 1.
Figure 3:
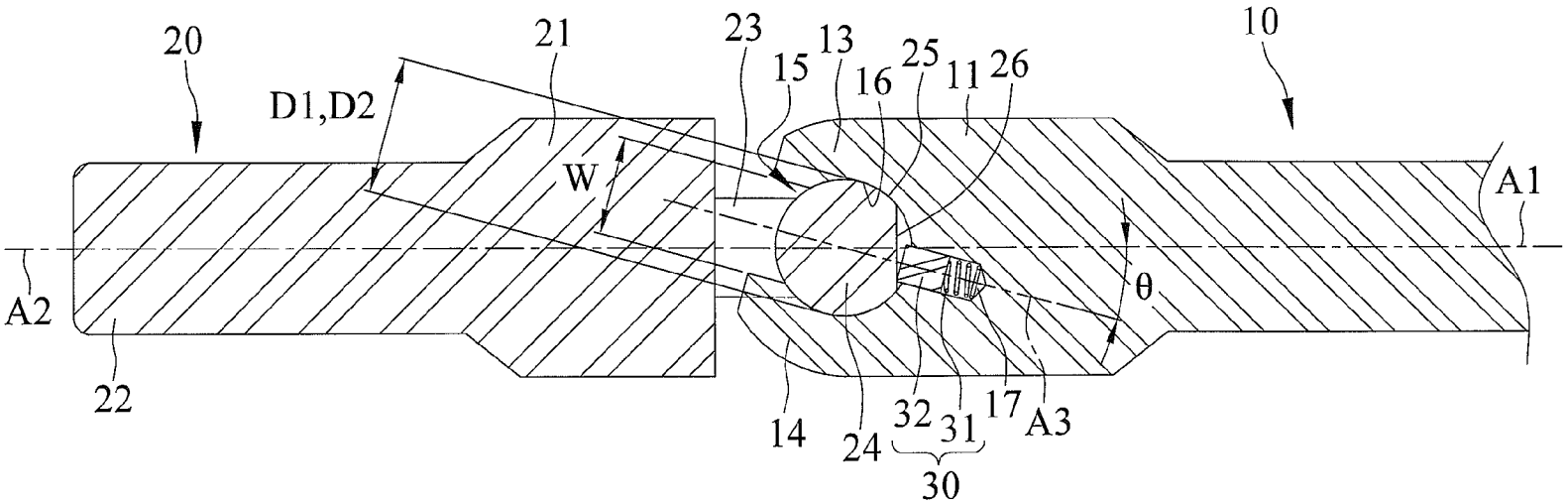
FIG. 3 shows a cross-section view taken along line 3-3 of FIG. 1.
Figure 4:
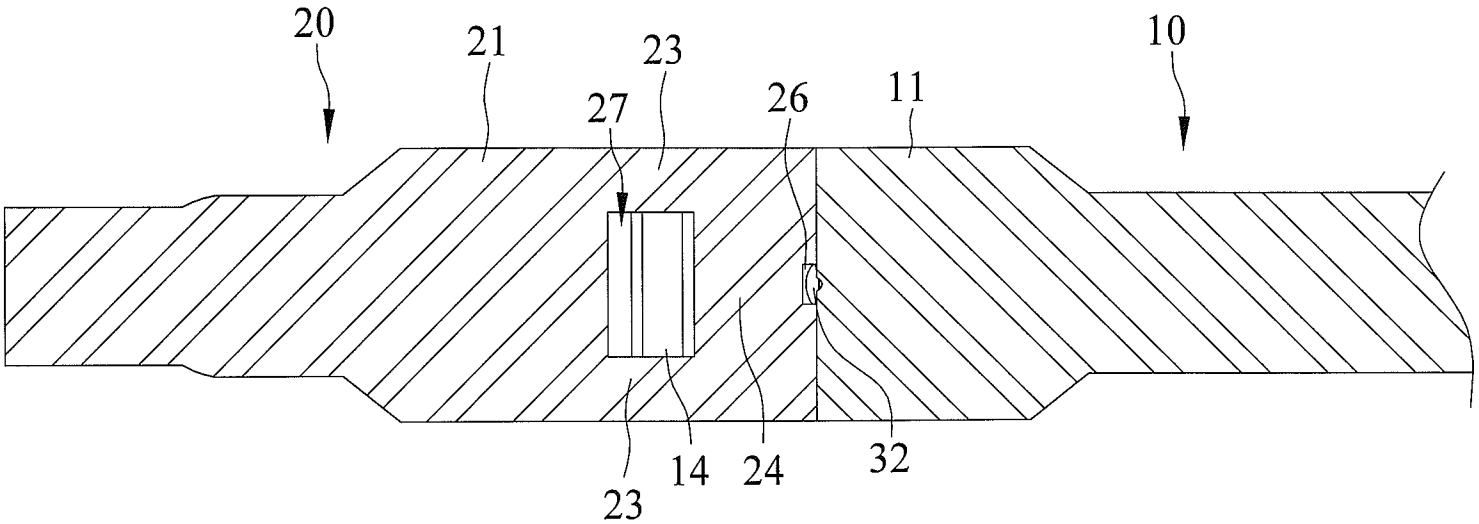
FIG. 4 shows a cross-section view taken along line 4-4 of FIG. 1.
Figure 5:
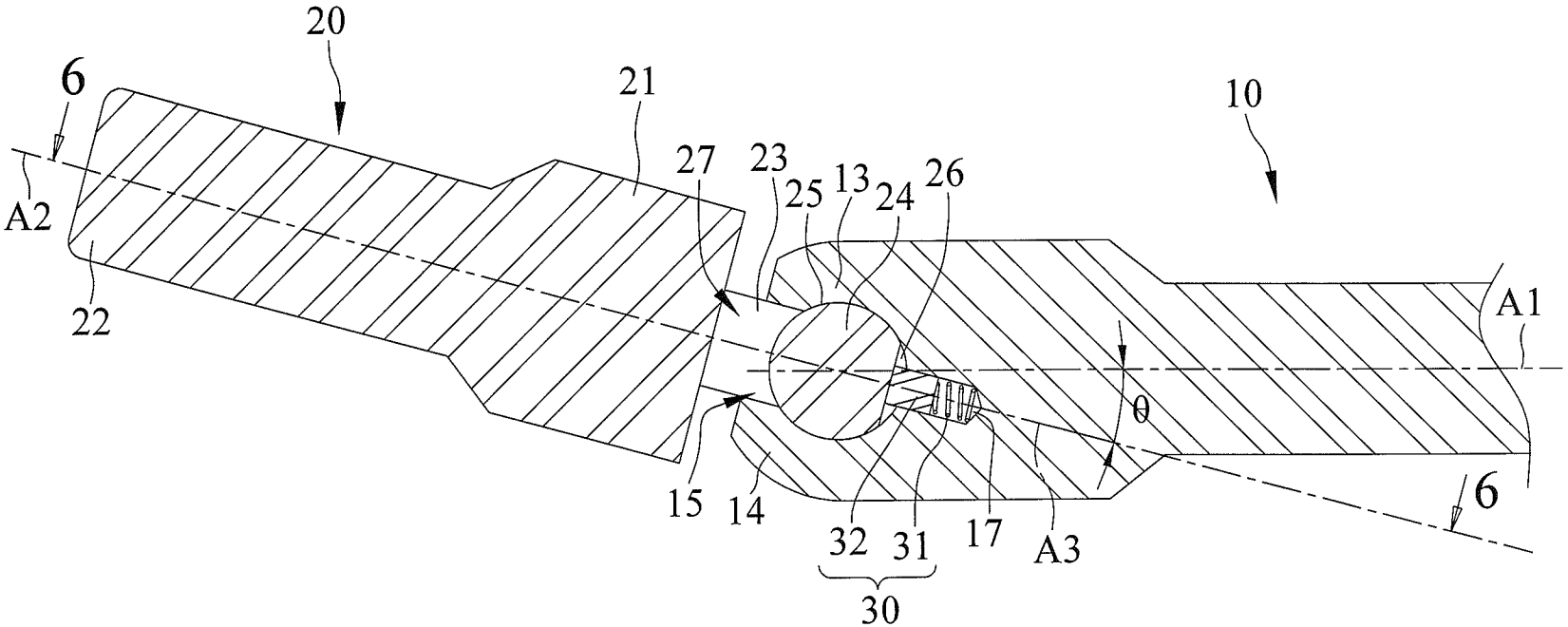
FIG. 5 shows a continued, cross-section view of FIG. 3, and illustrates the first axis and a third axis being coaxial.
Figure 6:
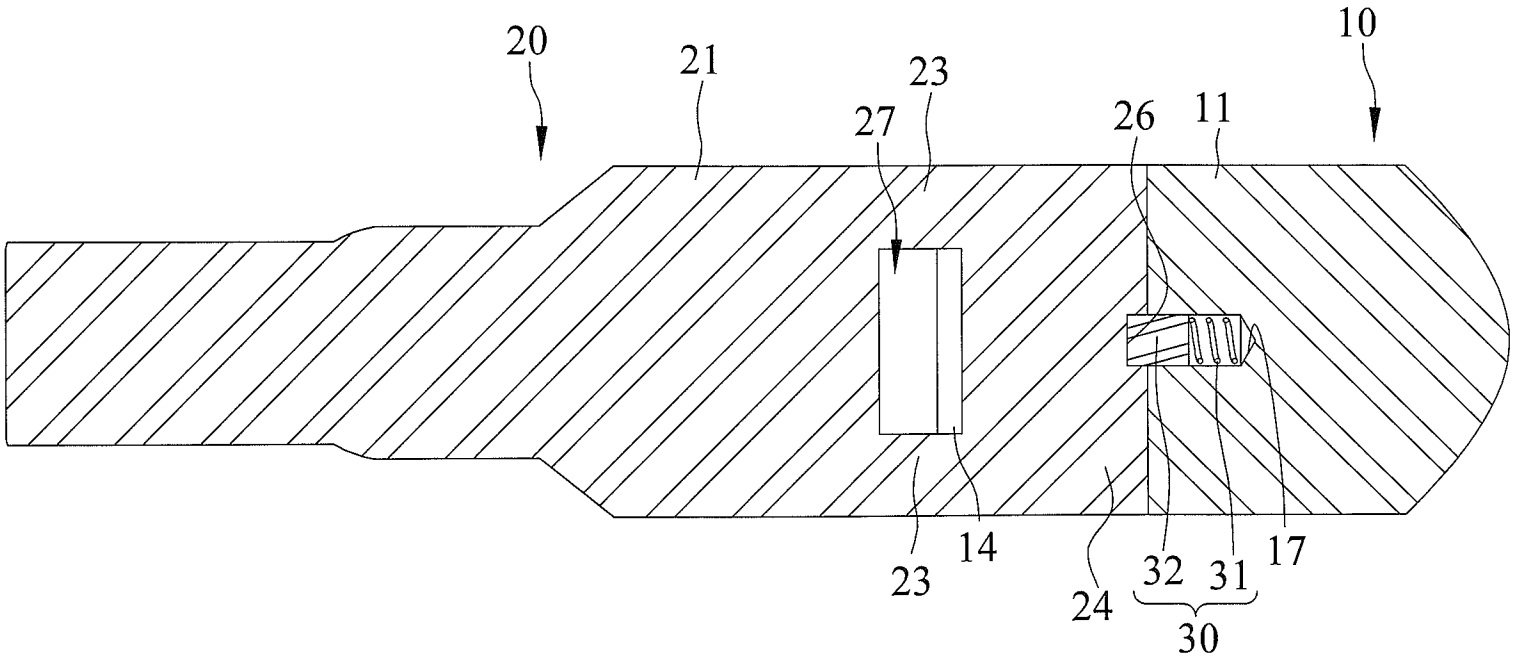
FIG. 6 shows a cross-section view taken along line 6-6 of FIG. 5.
Figure 7:
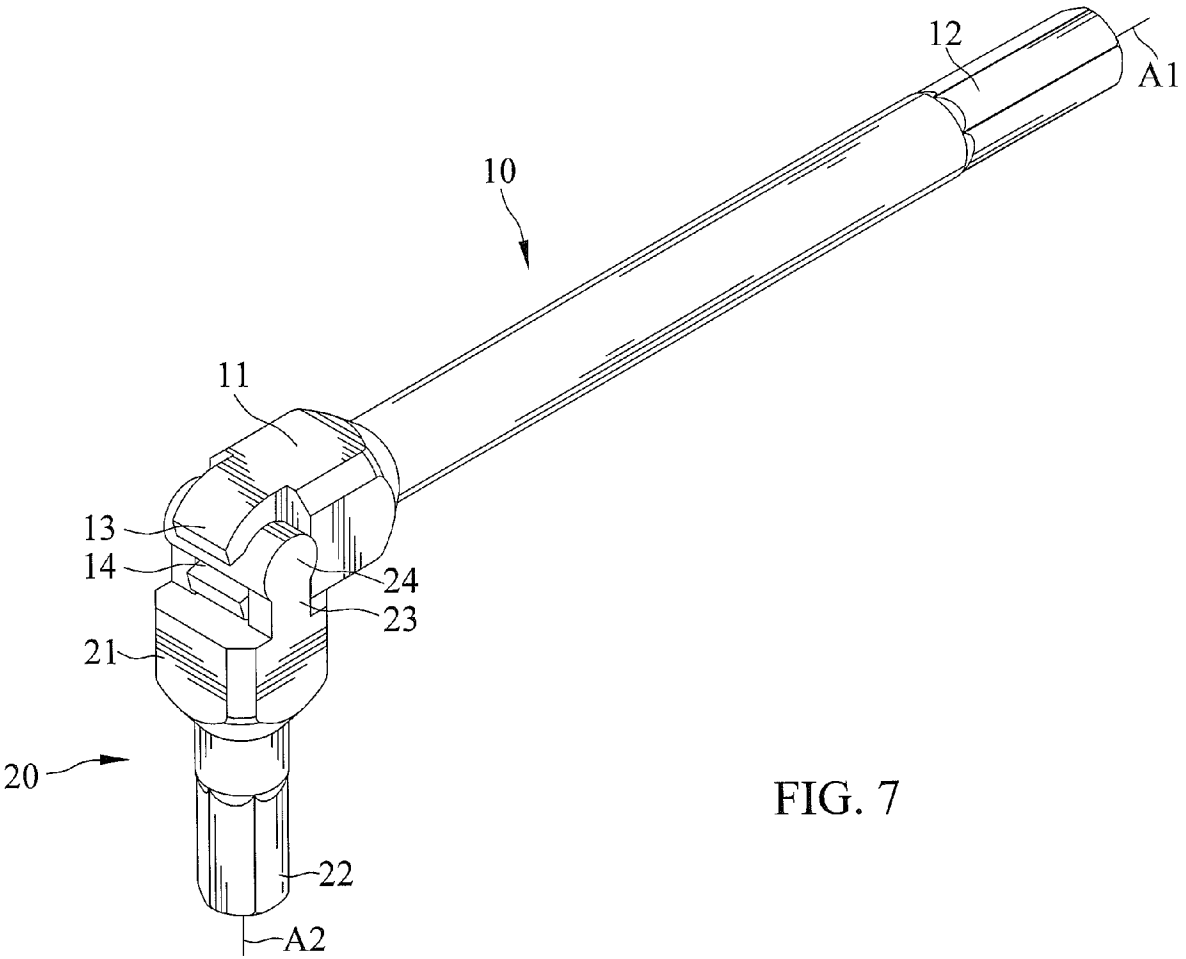
FIG. 7 shows a perspective view of the pivoting assembly for the hand tool of FIG. 1, and illustrates the first axis perpendicular to the second axis.
Figure 8:
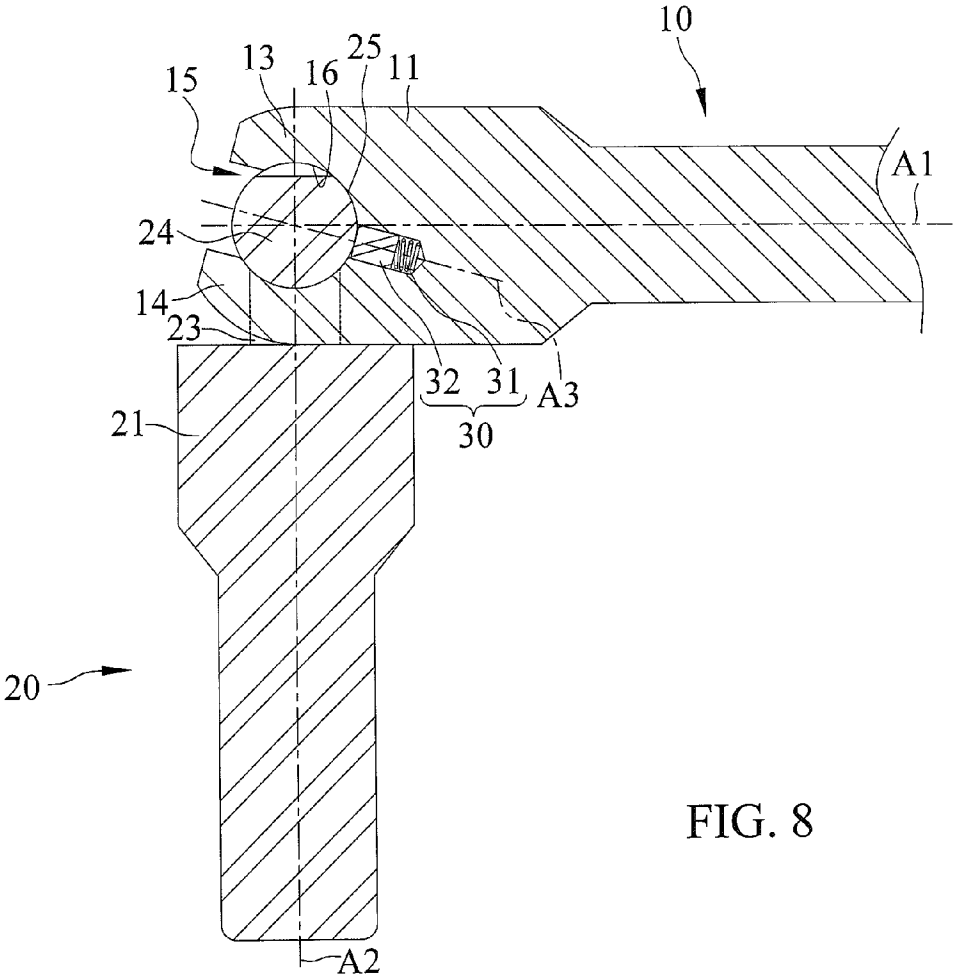
FIG. 8 shows a partial, enlarged cross-section view of FIG. 7.

FIGS. 1 through 8 show a first embodiment of a pivoting assembly for a hand tool according to the present invention shown in the drawings. The pivoting assembly for the hand tool includes first and second stems 10 and 20 pivotally connected with each other. The first stem 10 includes a first connecting end 11 and a first driving end 12 spaced from the first connecting end 11 along a first axis A1. The first driving end 12 of the first stem 10 can drive objects or is adapted to be gripped as a handle by a user. The second stem 20 includes a second connecting end 21 and a second driving end 22 spaced from the second connecting end 21 along a second axis A2. The second connecting end 21 of the second stem 20 is pivotally connected with the first connecting end 11 of the first stem 10. The second driving end 22 of the second stem 20 can drive objects or is adapted to be gripped as a handle by a user.

The first stem 10 has a first length L1 extending along the first axis A1 from the first connecting end 11 to the first driving end 12 thereof. Moreover, the first stem 10 includes first and second jaw portions 13 and 14 respectively extending from top and bottom faces of the first connecting end 11 along a direction parallel to the first axis A1 and a direction parallel to a third axis A3. An opening 15 is formed between distal end faces of the first and second jaw portions 13 and 14. Moreover, distal ends of the first and second jaw portions 13 and 14 adjacent to the opening 15 are respectively extended partially toward the first axis A1 and the third axis A3. The first and third axes A1 and A3 form an included angle θ, which may be formed about zero degree to 90 degrees. The opening 15 has a width W formed between the distal end faces of the first and second jaw portions 13 and 14. An inner periphery surface 16 is formed between a terminal face of the first connecting end 11 and the first and second jaw portions 13 and 14. The inner periphery surface 16 is connected with the opening 15 and has an arched surface, and an inner diameter D1 is defined therein. The inner diameter D1 is greater than the width W. An aperture 17 is extended along the third axis A3 in the inner periphery surface 16. A positioning device 30 is received in the aperture 17 and includes a biasing member 31 and an engaging member 32. In a preferred form, the biasing member 31 is a spring, and the engaging member 32 is a cylindrical block.

The second stem 20 has a second length L2 extending along the second axis A2 from the second connecting end 21 to the second driving end 22 thereof. Additionally, the second length L2 of the second stem 20 is less than the first length L1 of the first stem 10. Moreover, the second stem 20 includes two arm portions 23 respectively extending from two opposite ends of a terminal face of the second connecting end 21 along a direction parallel to the second axis A2, and an engaging portion 24 formed between distal ends of the two arm portions 23 opposite to the terminal face of the second connecting end 21. The engaging portion 24 has a columnar cross section parallel to the second axis A2, and includes an outer periphery surface 25 having an outer diameter D2 equal to the inner diameter D1 of the inner periphery surface 16. The engaging portion 24 further includes an abutting recess 26 formed at the outer periphery surface 25 and extended perpendicularly to the second axis A2. A gap 27 is formed between the two arm portions 23 and the engaging portion 24. The gap 27 is adapted for receiving the first and second jaw portions 13 and 14. The engaging portion 24 of the second stem 20 is engaged and received between the first and second jaw portions 13 and 14. The outer periphery surface 25 of the engaging portion 24 is in contact with the inner periphery surface 16. Therefore, the second stem 20 is pivotally connected with the first stem 10. Moreover, the outer diameter D2 of the outer periphery surface 25 is greater than the width W of the opening 15 to cause the second stem 20 to be unable to disengage from the first stem 10 along the second axis A2.

The biasing member 31 is abutting and biasing against the engaging member 32 to cause the engaging member 32 to engage within the abutting recess 26 of the second stem 20 resulting in the second stem 20 being unable to disengage from the first stem 10 along a direction perpendicular to the second axis A2.

When the second stem 20 is pivoted relative to the first stem 10 to cause the first and second axes A1 and A2 to be coaxial, the engaging member 32 is engaged in the abutting recess 26 and abutted against a bottom surface of the abutting recess 26, with the second jaw portion 14 received into the gap 27.

When the second stem 20 is pivoted clockwise relative to the first stem 10 with the included angle θ to cause the second and third axes A2 and A3 to be coaxial, the engaging member 32 is engaged in the abutting recess 26 and an end face of the engaging member 32 is firmly attached with the bottom surface of the abutting recess 26. Therefore, the second stem 20 is disposed relative to the first stem 10 with the included angle θ quickly. In the meantime, the second jaw portion 14 escapes from the gap 27.

When the second stem 20 is pivoted counterclockwise relative to the first stem 10 to cause the first and second axes A1 and A2 to be mutually perpendicular, the bottom face of the first connecting end 11 of the first stem 10 is abutted against the terminal face of the second connecting end 21 of the second stem 20, with the second jaw portion 14 passing through the gap 27, and with the engaging member 32 abutted against the outer periphery surface 25 of the engaging portion 24.

Figure 9:
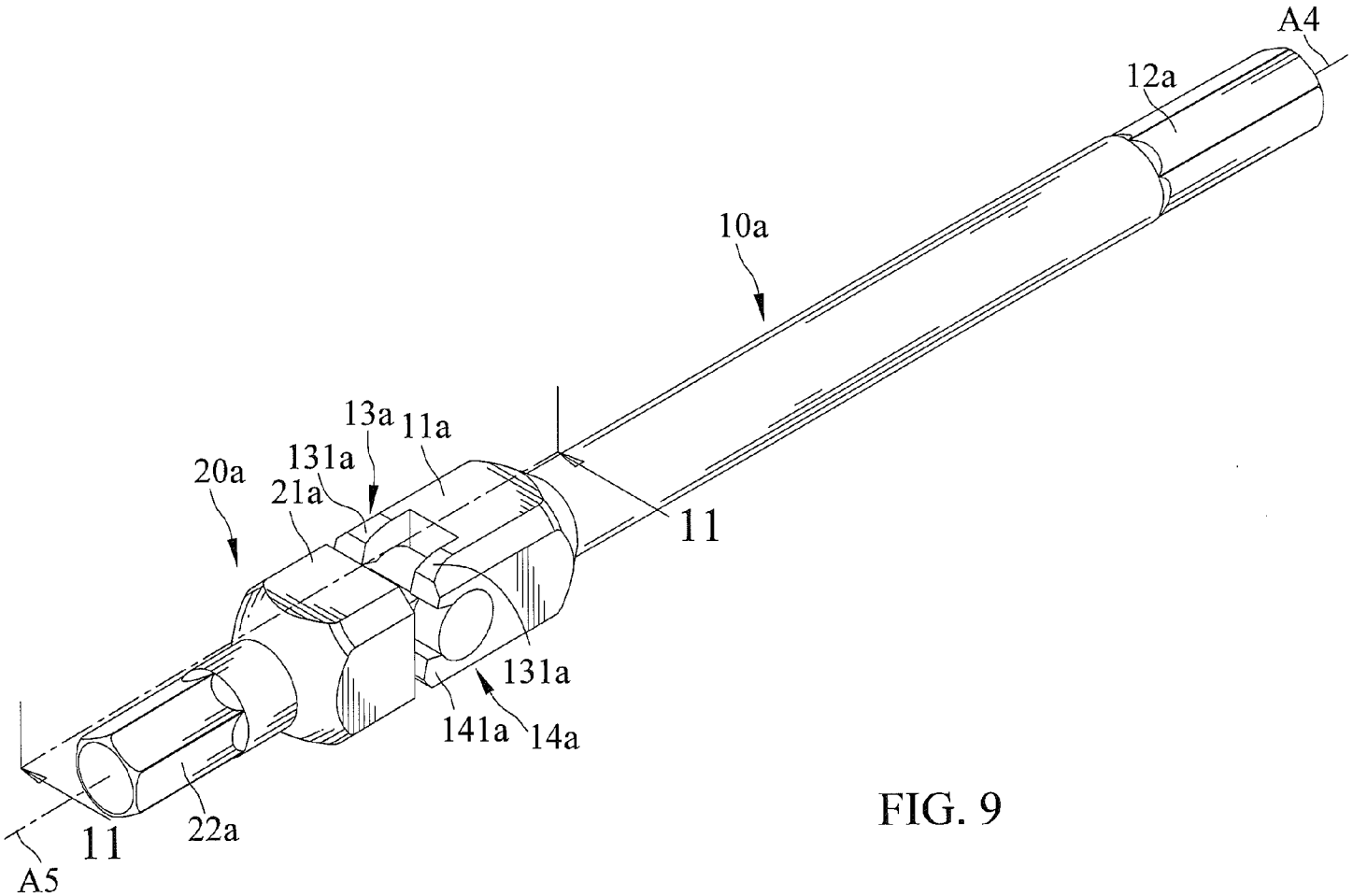
FIG. 9 shows a perspective view of a pivoting assembly for a hand tool of a second embodiment according to the present invention, and illustrates first and second axes being coaxial.
Figure 10:
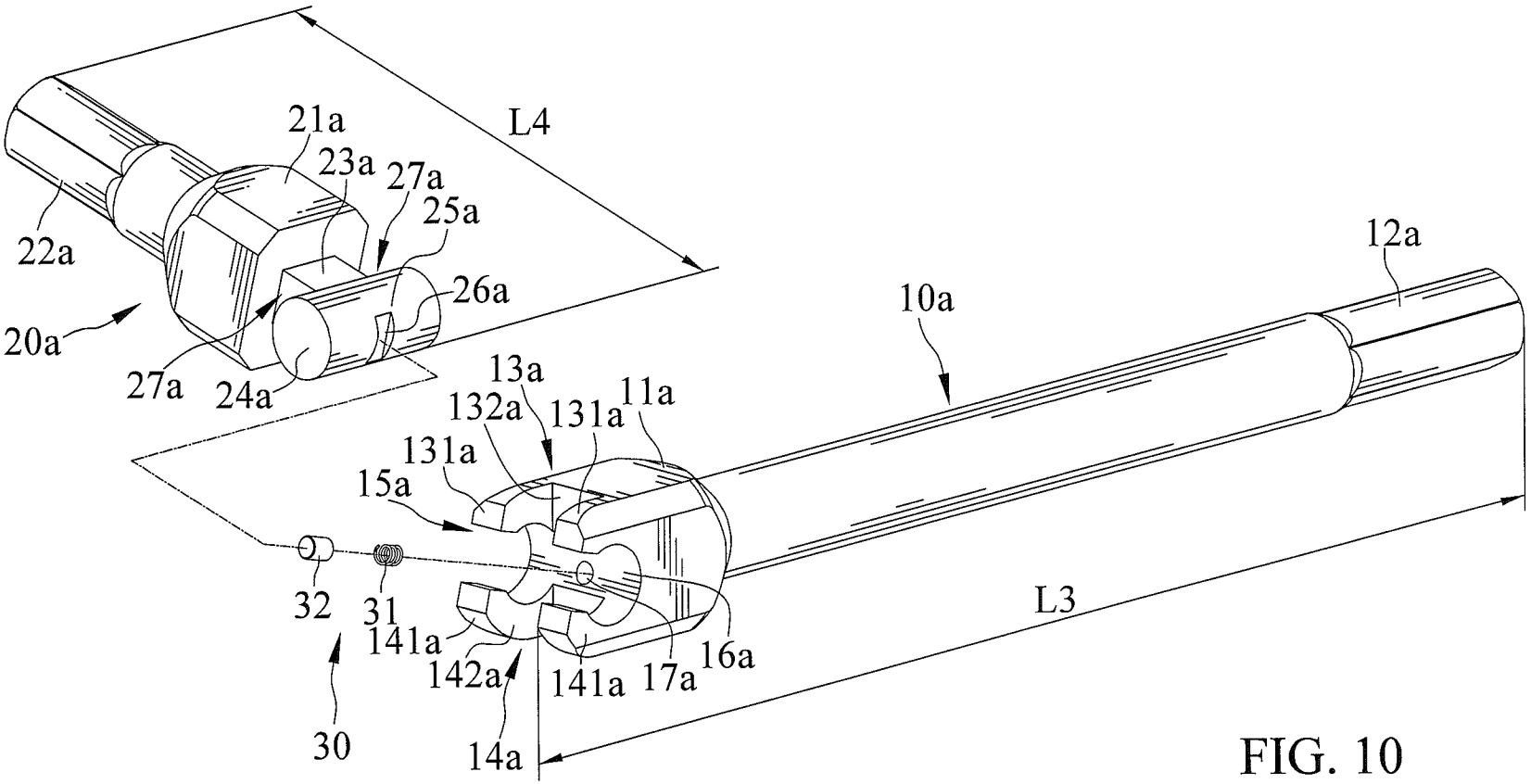
FIG. 10 shows an exploded, perspective view of the pivoting assembly for the hand tool of FIG. 9.
Figure 11:
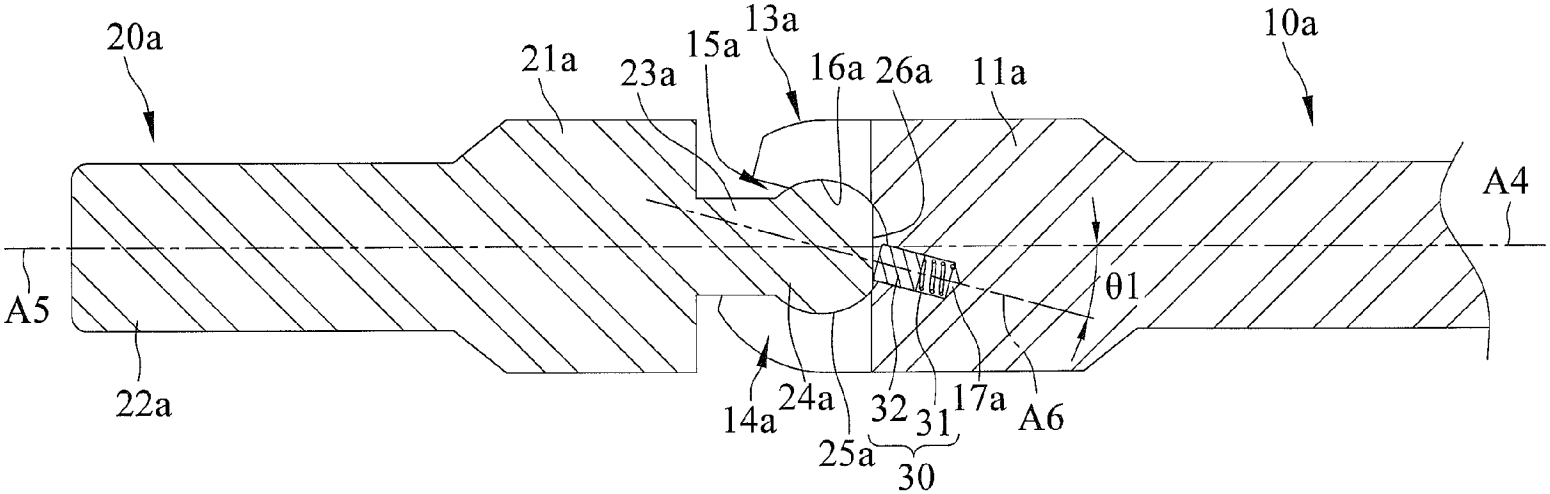
FIG. 11 shows a cross-section view taken along line 11-11 of FIG. 9.
Figure 12:
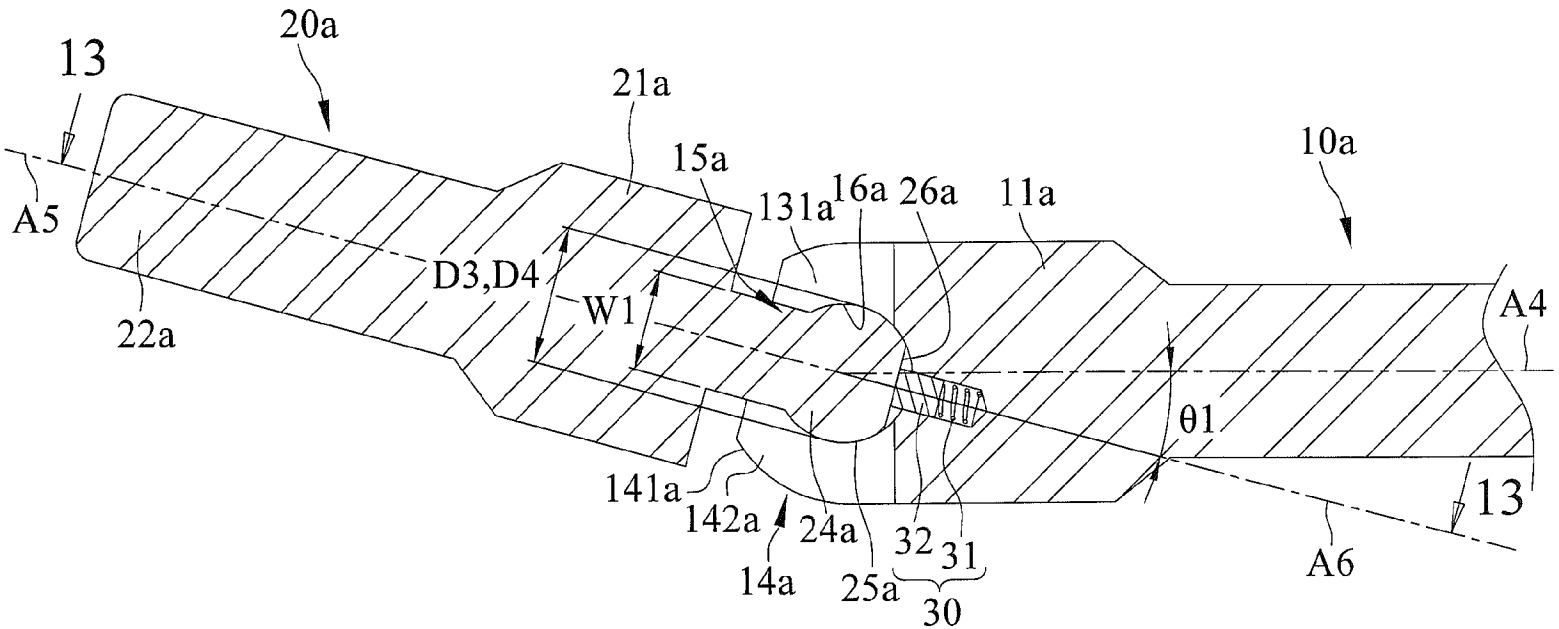
FIG. 12 shows a continued, cross-section view of FIG. 11, and illustrates the first axis and a third axis being coaxial.
Figure 13:
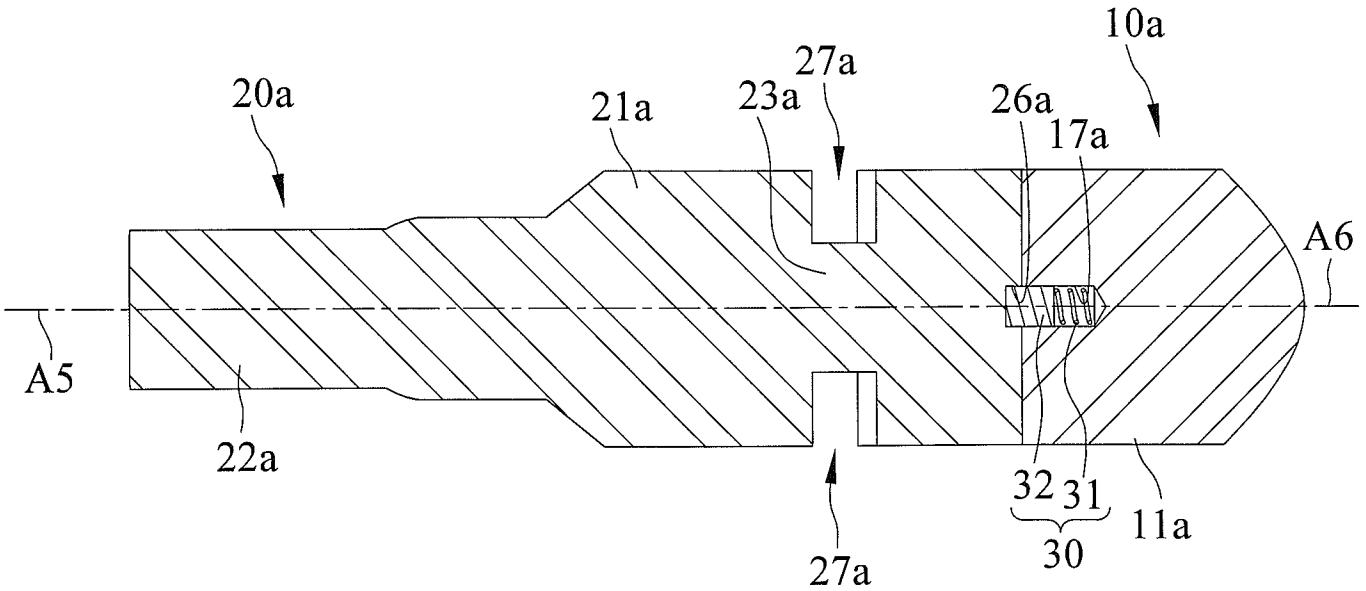
FIG. 13 shows a cross-section view taken along line 13-13 of FIG. 12.
Figure 14:
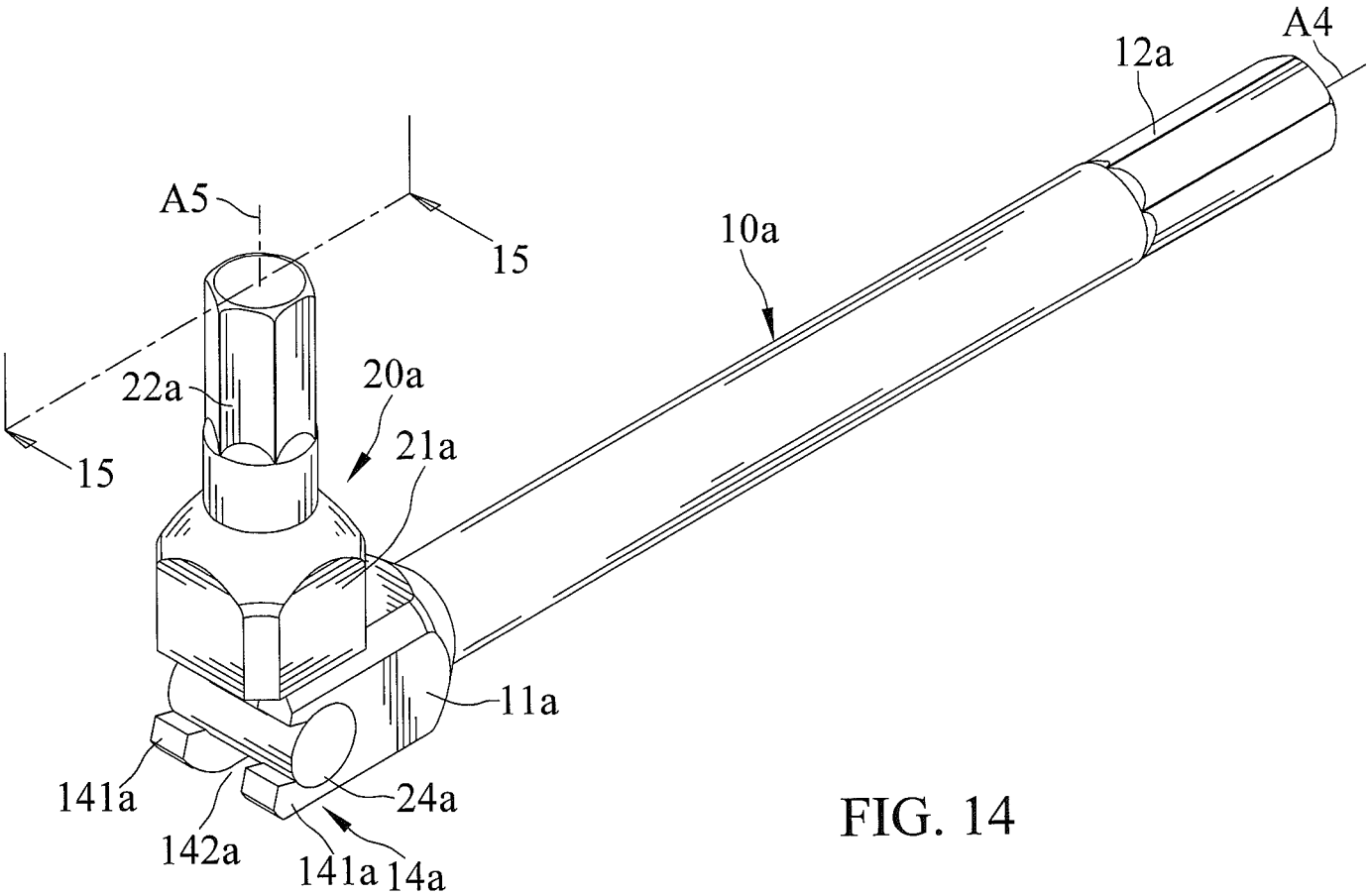
FIG. 14 shows a perspective view of the pivoting assembly for the hand tool of FIG. 9, and illustrates the first axis perpendicular to the second axis.
Figure 15:
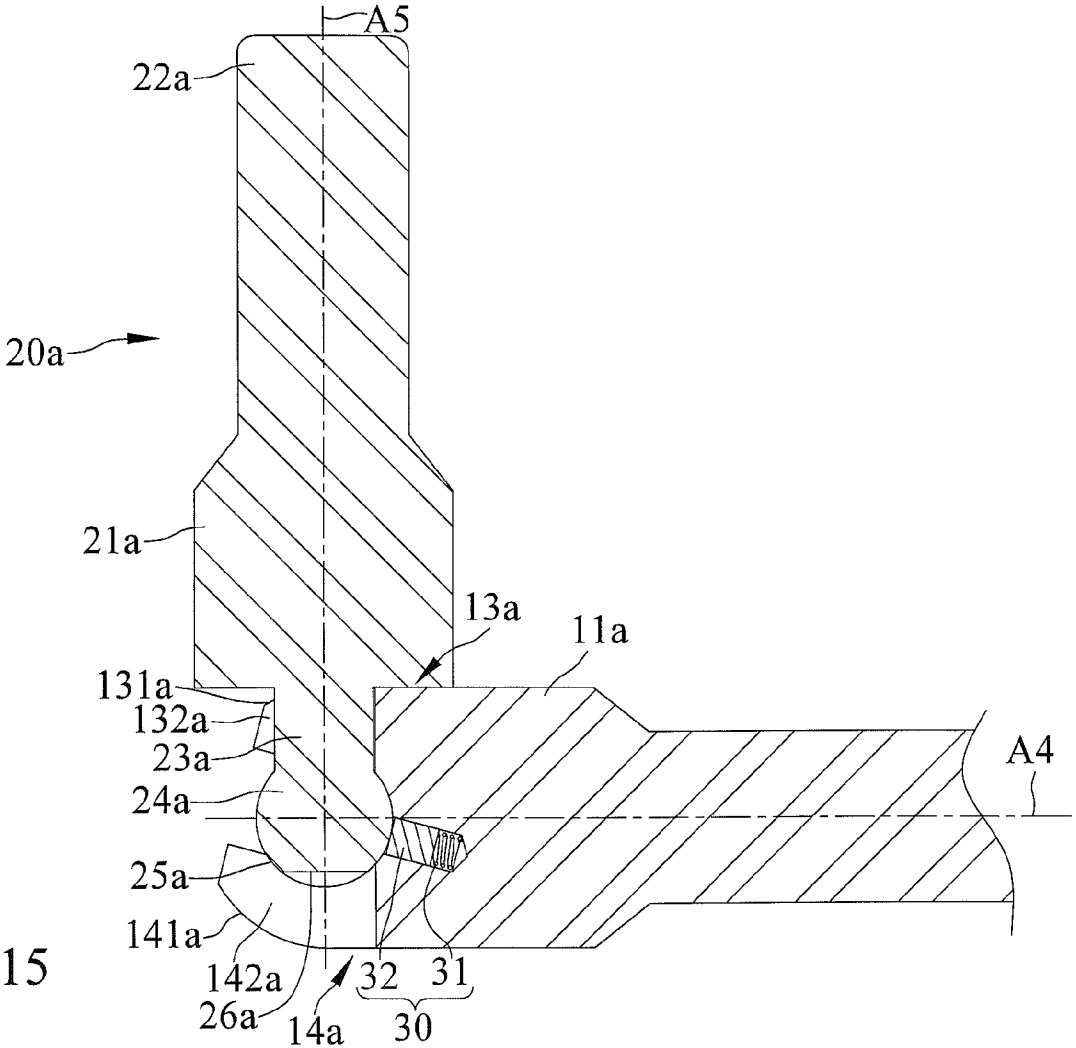
FIG. 15 shows a partial, enlarged cross-section view of FIG. 14.

FIGS. 9 through 15 show a second embodiment of the pivoting assembly for the hand tool according to the present invention shown in the drawings, with like numerals utilized to denote similar elements of the first embodiment, however, bearing a suffix "a". Specifically, the first stem 10*a* has the first length L3 extending along the first axis A4 from the first connecting end 11*a* to the first driving end 12*a* thereof. Moreover, the first stem 10*a* includes first and second jaw portions 13*a* and 14*a* respectively extending from top and bottom faces of the first connecting end 11*a* along a direction parallel to the first axis A4 and a direction parallel to a third axis A6. The first and third axes A4 and A6 form an included angle θ1, which may be formed about zero degree to 90 degrees. The first jaw portion 13*a* includes two first extending sections 131*a* and a first slot 132*a* formed between the two first extending sections 131*a*. The second jaw portion 14*a* includes two second extending sections 141*a* formed corresponding to the two first extending sections 131*a*, and a second slot 142*a* formed between the two second extending sections 141*a*. Moreover, distal ends of the two first extending sections 131*a* of the first jaw portion 13 and distal ends of the two second extending sections 141*a* of the second jaw portion 14*a* are respectively extended partially toward the first axis A4. An opening 15*a* is formed between distal end faces of the first and second jaw portions 13*a* and 14*a* and connected and in communication with the first and second slots 132*a* and 142*a*.

The opening 15*a* has a width W1 formed between the distal end faces of the first and second jaw portions 13*a* and 14*a*. An inner periphery surface 16*a* is formed between the terminal face of the first connecting end 11*a* and the first and second jaw portions 13*a* and 14*a*. The inner periphery surface 16*a* is connected with the opening 15*a* and has an arched surface, and the inner diameter D3 defined therein. The inner diameter D3 is greater than the width W1. An aperture 17*a* is extended along the third axis A6 in the inner periphery surface 16*a*. The positioning device 30 is received in the aperture 17*a*.

The second stem 20*a* has the second length L4 extending along the second axis A5 from the second connecting end 21*a* to the second driving end 22*a* thereof Additionally, the second length L4 of the second stem 20*a* is less than the first length L3 of the first stem 10*a*. Moreover, the second stem 20*a* includes the arm portions 23*a* extending from the terminal face of the second connecting end 21*a* along the second axis A5, and an engaging portion 24*a* formed at the distal end of the arm portions 23*a* opposite to the terminal face of the second connecting end 21*a* and extended perpendicularly to the second axis A5. The first and second slots 132*a* and 142*a* are adapted for receiving the arm portions 23*a*. The engaging portion 24*a* has a columnar cross section parallel to the second axis A5, and includes an outer periphery surface 25*a* having the outer diameter D4 equal to the inner diameter D3, and an abutting recess 26*a* formed at the outer periphery surface 25*a* and extended perpendicularly to the second axis A5. Two gaps 27*a* are respectively formed between the terminal face of the second connecting end 21*a*, two side faces of the arm portions 23*a*, and the outer periphery surface 25*a* of the engaging portion 24*a*.

The engaging portion 24*a* of the second stem 20*a* is engaged and received between the first and second jaw portions 13*a* and 14*a*. The outer periphery surface 25*a* of the engaging portion 24*a* is in contact with the inner periphery surface 16*a*. Therefore, the second stem 20*a* is pivotally connected with the first stem 10*a*.

The biasing member 31 is abutted and biased against the engaging member 32 to cause the engaging member 32 to engage within the abutting recess 26*a* of the second stem 20*a* resulting in the second stem 20*a* being unable to disengage from the first stem 10*a* along the direction perpendicular to the second axis A5.

When the second stem 20*a* is pivoted relative to the first stem 10*a* to cause the first and second axes A4 and A5 to be coaxial, the engaging member 32 is engaged in the abutting recess 26*a* and abutted against a bottom surface of the abutting recess 26*a*, with the two second extending sections 141*a* of the second jaw portion 14*a* received into the two gaps 27*a*, and with the arm portion 23*a* received into the second slot 142*a* of the second jaw portion 14*a*.

When the second stem 20*a* is pivoted clockwise relative to the first stem 10*a* with the included angle θ1 causing the second and third axes A5 and A6 to be coaxial, the engaging member 32 is engaged in the abutting recess 26*a*, and the end face of the engaging member 32 is firmly attached with the bottom surface of the abutting recess 26*a*. Therefore, the second stem 20*a* is disposed relative to the first stem 10*a* with the included angle θ1 quickly. In the meantime, the two second extending sections 141*a* of the second jaw portion 14*a* and the arm portion 23*a* respectively escape from the two gaps 27*a* and the second slot 142*a* of the second jaw portion 14*a*.

When the second stem 20*a* is sequentially pivoted clockwise relative to the first stem 10*a* to cause the first and second axes A4 and A5 to be mutually perpendicular, the top face of the first connecting end 11*a* of the first stem 10*a* is abutted against the terminal face of the second connecting end 21*a* of the second stem 20*a*, with the two second extending sections 141*a* of the second jaw portion 14*a* escaping from the two gaps 27*a*, with the arm portion 23*a* received into the first slot 132*a* of the first jaw portion 13*a*, and with the engaging member 32 abutted against the outer periphery surface 25*a* of the engaging portion 24*a*.

The pivoting assembly for the hand tool includes the following advantages:

1. The pivoting assembly for the hand tool includes first and second stems 10, 10*a*, 20, and 20*a* pivotally connected with each other without a pin to prevent forming holes for inserting the pin at the two stems 10, 20, 10*a*, and 20*a* to keep the strength of the pivoting assembly so that the hand tool can apply high torque to turn objects.

2. The engaging portion 24 and 24*a* of the second stem 20 and 20*a* is engaged and received between the first and second jaw portions 13, 14, 13*a*, and 14*a* to cause the outer periphery surface 25 and 25*a* of the engaging portion 24 and 24*a* to be in contact with the inner periphery surface 16 and 16*a*. Moreover, the outer diameter D2 and D4 of the outer periphery surface 25 and 25*a* of the engaging portion 24 and 24*a* is greater than the width W and W1 of the opening 15 and 15*a* to cause the second stem 20 and 20*a* to be unable to disengage from the first stem 10 and 10*a*.

3. The biasing member 31 is abutted and biased against the engaging member 32 to cause the engaging member 32 to engage within the abutting recess 26 and 26*a* of the second stem 20 and 20*a* resulting in the second stem 20 and 20*a* being unable to disengage from the first stem 10 and 10*a* along a direction perpendicular to the second axis A2 and A5.

4. The first and third axes A1, A4, A3, and A6 form the included angle θ and θ1, which may be formed about zero degree to 90 degrees, and the aperture 17 and 17*a* is extended along the third axis A3 and A6 in the inner periphery surface 16 and 16*a* and receives the positioning device 30 to cause the positioning device 30 to be unable to disengage from the aperture 17 and 17*a*.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A pivoting assembly for a hand tool comprising:

a first stem including a first connecting end, a first driving end spaced from the first connecting end, and first and second jaw portions respectively extending from the first connecting end, with an opening formed between distal end faces of the first and second jaw portions, with an inner periphery surface formed between the first connecting end and the first and second jaw portions;

a second stem pivotally connected with the first stem and including a second connecting end, a second driving end spaced from the second connecting end, and two arm portions respectively extending from two opposite end of a terminal face of the second connecting end, with an engaging portion formed at an end of the two arm portions opposite to the second connecting end, with the engaging portion including an outer periphery surface and engaged with the first and second jaw portions, with the outer periphery surface abutted against the inner periphery surface, with a gap formed between the two arm portions and the engaging portion, with the gap selectively receiving the first and second jaw portions.

2. The pivoting assembly for the hand tool as claimed in claim 1, wherein an aperture is extended in the inner periphery surface, with a positioning device received in the aperture and abutted against the engaging portion of the second stem.

3. The pivoting assembly for the hand tool as claimed in claim 1, wherein the first driving end is spaced from the first connecting end along a first axis, with the second driving end spaced from the second connecting end along a second axis, with the first and second jaw portions respectively extending from top and bottom faces of the first connecting end along a direction parallel to the first axis and a direction parallel to a third axis, with the first and third axes forming an included angle.

4. The pivoting assembly for the hand tool as claimed in claim 3, wherein the included angle is formed between zero degree to 90 degrees.

5. The pivoting assembly for the hand tool as claimed in claim 3, wherein the engaging portion includes an abutting recess formed at the outer periphery surface and extended perpendicularly to the second axis, wherein the positioning device includes a biasing member and an engaging member, with the biasing member abutting and biasing against the engaging member, with the engaging member selectively engaging in the abutting recess of the second stem.

6. The pivoting assembly for the hand tool as claimed in claim 5, wherein when the second stem is pivoted relative to the first stem to cause the first and second axes to be coaxial, the engaging member is engaged in the abutting recess and abutted against a bottom surface of the abutting recess, with the second jaw portion received into the gap.

7. The pivoting assembly for the hand tool as claimed in claim 5, wherein when the second stem is pivoted relative to the first stem to cause the second and third axes to be coaxial, the engaging member is engaged in the abutting recess, and an end face of the engaging member is firmly attached with a bottom surface of the abutting recess, with the second jaw portion escaping from the gap.

8. The pivoting assembly for the hand tool as claimed in claim 5, wherein when the second stem is pivoted relative to the first stem to cause the first and second axes to be mutually perpendicular, the bottom face of the first connecting end of the first stem abuts against the terminal face of the second connecting end of the second stem, and with the second jaw portion passing through the gap, with the engaging member abutted against the outer periphery surface of the engaging portion.

9. The pivoting assembly for the hand tool as claimed in claim 2, wherein the two arm portions extend from a terminal face of the second connecting end, with two gaps respectively formed between the terminal face of the second connecting end, two side faces of the arm portions, and the outer periphery surface of the engaging portion, and with the gap selectively receiving the first and second jaw portions.

10. The pivoting assembly for the hand tool as claimed in claim 9, wherein the first driving end is spaced from the first connecting end along a first axis, with the second driving end spaced from the second connecting end along a second axis, with the first and second jaw portions respectively extending from top and bottom faces of the first connecting end along a direction parallel to the first axis and a direction parallel to a third axis, with the first and third axes forming an included angle.

11. The pivoting assembly for the hand tool as claimed in claim 1, wherein the inner periphery surface is connected with the opening and has an inner diameter, wherein the outer periphery surface has an outer diameter equal to the inner diameter of the inner periphery surface, wherein the opening has a width formed between the distal end faces of the first and second jaw portions, and wherein the inner diameter is greater than the width.

12. The pivoting assembly for the hand tool as claimed in claim 1, wherein the first driving end of the first stem and the second driving end of the second stem are adapted for driving objects as a hand tool.

13. The pivoting assembly for the hand tool as claimed in claim 1, wherein the first driving end of the first stem and the second driving end of the second stem are adapted to be gripped as a handle by a user.

14. The pivoting assembly for the hand tool as claimed in claim 1, wherein the first stem has a first length extending along a first axis from the first connecting end to the first driving end thereof, wherein the second stem has a second length extending along a second axis from the second connecting end to the second driving end thereof, and wherein the second length of the second stem is less than the first length of the first stem.

15. A pivoting assembly for a hand tool comprising:

a first stem including a first connecting end, a first driving end spaced from the first connecting end, and first and second jaw portions respectively extending from the first connecting end, with an opening formed between distal end faces of the first and second jaw portions, with an inner periphery surface formed between the first connecting end and the first and second jaw portions;

a second stem pivotally connected with the first stem and including a second connecting end, a second driving end spaced from the second connecting end, and at least one arm portion extending from the second connecting end, with an engaging portion formed at an end of the at least one arm portion opposite to the second connecting end, with the engaging portion including an outer periphery surface and engaged with the first and second jaw portions, with the outer periphery surface abutted against the inner periphery surface;

wherein the first jaw portion includes two first extending sections and a first slot formed between the two first extending sections, wherein the second jaw portion includes two second extending sections formed corresponding to the two first extending sections, and a second slot formed between the two second extending sections, with the first and second slots selectively receiving the at least one arm portion.

16. A pivoting assembly for a hand tool comprising:

a first stem including a first connecting end, a first driving end spaced from the first connecting end, and first and second jaw portions respectively extending from the first connecting end, with an opening formed between distal end faces of the first and second jaw portions, with an inner periphery surface formed between the first connecting end and the first and second jaw portions;

a second stem pivotally connected with the first stem and including a second connecting end, a second driving end spaced from the second connecting end, and at least one arm portion extending from a terminal face of the second connecting end, with two gaps respectively formed between the terminal face of the second connecting end, two side faces of the at least one arm portion, and the outer periphery surface of the engaging portion, with the gap selectively receiving the first and second jaw portions, with an engaging portion formed at an end of the at least one arm portion opposite to the second connecting end, with the engaging portion including an outer periphery surface and engaged with the first and second jaw portions, with the outer periphery surface abutted against the inner periphery surface;

wherein the first driving end is spaced from the first connecting end along a first axis, with the second driving end spaced from the second connecting end along a second axis, with the first and second jaw portions respectively extending from top and bottom faces of the first connecting end along a direction parallel to the first axis and a direction parallel to a third axis, with the first and third axes forming an included angle; and wherein the engaging portion includes an abutting recess formed at the outer periphery surface and extended perpendicularly to the second axis, and wherein the positioning device includes a biasing member and an engaging member, with the biasing member abutting and biasing against the engaging member, and with the engaging member selectively engaging in the abutting recess of the second stem.

17. The pivoting assembly for the hand tool as claimed in claim 16, wherein when the second stem is pivoted relative to the first stem to cause the first and second axes to be coaxial, the engaging member is engaged in the abutting recess and abutted against a bottom surface of the abutting recess, with the two second extending sections of the second jaw portion received into the two gaps, and with the at least one arm portion received into the second slot of the second jaw portion.

18. The pivoting assembly for the hand tool as claimed in claim 16, wherein when the second stem is pivoted relative to the first stem to cause the second and third axes to be coaxial, the engaging member is engaged in the abutting recess and an end face of the engaging member is firmly attached with a bottom surface of the abutting recess, with the two second extending sections of the second jaw portion and the at least one arm portion respectively escape from the two gaps and the second slot of the second jaw portion.

19. The pivoting assembly for the hand tool as claimed in claim 16, wherein when the second stem is pivoted relative to the first stem to cause the first and second axes to be mutually perpendicular, the top face of the first connecting end of the first stem abuts against the terminal face of the second connecting end of the second stem, with the two second extending sections of the second jaw portion escaping from the two gaps, with the at least one arm portion received into the first slot of the first jaw portion, and with the engaging member abutted against the outer periphery surface of the engaging portion.

* * * * *